United States Patent [19]

Dunn

[11] 4,042,521

[45] Aug. 16, 1977

[54] FIRE EXTINGUISHING COMPOSITION

[76] Inventor: Byron G. Dunn, 6831 Orchid Lane, Dallas, Tex. 75230

[21] Appl. No.: 400,640

[22] Filed: Nov. 26, 1973

Related U.S. Application Data

[63] Continuation-in-part of Ser. No. 400,623, Sept. 25, 1973, Pat. No. 3,889,754, which is a continuation-in-part of Ser. No. 131,333, April 5, 1971, Pat. No. 3,733,111.

[51] Int. Cl.[2] ..... A62D 1/00

[52] U.S. Cl. ..... 252/5; 252/7

[58] Field of Search ..... 252/7, 5, 3, 2

[56] References Cited

U.S. PATENT DOCUMENTS

| | | | |
|---|---|---|---|
| 683,211 | 9/1901 | Lacey | 252/7 |
| 1,421,428 | 7/1922 | Eckelmann | 252/3 |
| 1,441,728 | 1/1923 | Kent | 252/3 |
| 1,599,006 | 9/1926 | Burgess | 252/3 |
| 1,891,673 | 12/1932 | Gilleo | 252/7 |
| 1,922,510 | 8/1933 | Urquhart et al. | 252/3 |
| 1,924,401 | 8/1933 | Gilleo | 252/7 |
| 3,179,589 | 4/1965 | Lobos | 252/7 |
| 3,267,030 | 8/1966 | Dessart | 252/7 |
| 3,531,407 | 9/1970 | Phillips et al. | 252/7 |
| 3,544,459 | 12/1970 | Hirst | 252/7 |

*Primary Examiner*—Stephen C. Bentley
*Assistant Examiner*—Peter A. Nelson

[57] ABSTRACT

A dry fire extinguishing composition particularly useful in extinguishing Class B fires on cooking ranges and the like; comprising, between about 50% and 95% of an alkali metal bicarbonate, such as, sodium bicarbonate or an alkaline earth metal carbonate, such as, calcium carbonate and between about 50% and 5% of a metal silicate, such as, calcium silicate, magnesium silicate, etc.

8 Claims, No Drawings

FIRE EXTINGUISHING COMPOSITION

CROSS-REFERENCES TO RELATED APPLICATIONS

The present Application is a Continuation-in-part of application Ser. No. 400,623, filed Sept. 25, 1973, now U.S. Pat. No. 3,889,754, which, in turn, is a Continuation-in-part of application Ser. No. 131,333, filed Apr. 5, 1971, now U.S. Pat. No. 3,773,111, both by the present inventor. These prior applications are incorporated herein by reference.

BACKGROUND OF THE INVENTION

The present invention relates to a fire extinguishing composition. More particularly, the present invention relates to a dry fire extinguishing composition particularly useful in extinguishing Class B fires.

Fire extinguishers and fire extinguishing compositions, in general, are designed for extinguishing incipient fires. Incipient fires are divided into three general groups; namely, Class A, Class B and Class C. Class A fires are those occurring in ordinary combustible material, where the quenching and cooling effects of quantities of water or solutions containing a large percentage of water are of primary importance. This, of course, is the least difficult type of fire to extinguish. Class B fires are those occurring in oils, greases, flammable liquids, etc., where the blanketing or smothering effect of the extinguishing agent is of greatest importance. In this type of fire, liquid extinguishing materials are generally useless, particularly since they cause splattering, etc. of the liquid material which is aflame. Fires of this type are also the most difficult to extinguish since it is also necessary that the heat be cut off after the fire is initially extinguished so that the fire will not flashback or reignite in the liquid material. Hence, a fire extinguishing material for this type of fire must not only extinguish the original flame in a very short time but must have a holding capacity to maintain this condition and prevent or abate flashback or reignition. Class C fires are incipient fires of electrical equipment, where the non-conducting property of the extinguishing material is of prime importance. In this particular case, dry fire extinguishing agents are also more useful than liquid types not only because of their nonconductive properties but also because of their ability to abate reignition. In short, generally the same types of fire extinguishing materials as are useful for Class B fires are also best for Class C fires because of the possibility of reignition until the condition causing the fire has been remedied.

Statistics show that approximately 14 percent of all home fires are the result of Class B fires on kitchen ranges. Such fires are also quite prevalent on cooking units in restaurants, ship galleys, cooking units in recreational vehicles, etc. Under these conditions, one is not only faced with the inherent problems of Class B fires but the idiosyncrasies of use involved. As previously mentioned, there is the problem of the extinguishing agent causing the flaming oil or other liquid to splatter and thus spread the fire. It is also necessary, under these circumstances, that the fire be extinguished in an extremely short period of time, particularly where a vented hood is utilized above the cooking unit. Where a vented hood is utilized over the cooking unit, there is a tendency for grease and oil to accumulate in the fan and vent and any flame on the surface of the cooking unit will rapidly pass to the vent and ignite the collected oils and greases. Also, in connection with Class B fires and cooking units, in most cases the fire starts while the cooking unit is unattended, and, therefore, the heat under the cooking utensil or other item will not be turned off immediately. Consequently, even though the fire is initially extinguished, the heat under the oil or grease in the cooking utensil will flashback or reignite. One suggested solution to this problem has been to provide elaborate automatic cutoff systems for the burners of the cooking unit. However, this is, at best, an expensive and unsatisfactory solution. Accordingly, the most simple and inexpensive solution would be to provide a fire extinguishing material which would not only initially extinguish the flame in a very short time but would also hold this condition for an extended period of time even though the heat on the burner is not cut off. Finally, there is the problem of locating a fire extinguisher in the vicinity of the cooking unit so that it can be automatically triggered and extinguish the fire on the cooking unit. To date, this has been virtually impossible because of the lack of suitable extinguishing materials which are capable of withstanding the high temperatures and moisture conditions associated with normal cooking over an extended period of time. To date, there has been no satisfactory solution to this problem, since most known fire extinguishing compositions deteriorate over a period of time and must be replaced or renewed, and the problem is exaggerated by the heat and moisture to which the material would be subjected during normal cooking operations.

A large number of conventional fire extinguishers are charged with liquid type fire extinguishing materials. Obviously, Class B fires cannot be extinguished with water because of the extreme danger of splattering caused by the water hitting the flaming oil or grease. The same applies to any extinguishing composition containing substantial amounts of water, such as, calcium chloride solution. Consequently, carbon tetrachloride is one of the few known liquid extinguishing materials which is useful for extinguishing Class B and Class C fires. Carbon tetrachloride also has the advantage, over calcium chloride solutions and the conventional foam-type extinguishing materials, that it need not be renewed on a yearly basis as do the latter. While materials, such as, percloroethylene, bromocloroethane and methylbromide, have certain advantages over the previously mentioned liquid or foam-type extinguishing materials, these materials are rather expensive compared with the more common types of extinguishing agents. Most importantly, all known liquid type fire extinguishing materials have boiling points below about 121° C and therefore, these materials cannot be depended upon to last for any significant length of time when subjected to conventional temperatures encountered above a cooking range. While percloroethylene does have a boiling point of 121° C, all of the other liquids or solutions mentioned have boiling points below about 100° C. Thus, the materials will evaporate quite rapidly under normal cooking range conditions, and there is no guarantee that sufficient material will remain unevaporated when the need arises. Consequently, extinguishing materials for Class B fires, particularly on cooking ranges, are preferably the dry type fire extinguishing materials.

Most of the more common dry type fire extinguishing materials are useful in both Class B and Class C fires. This is due to the fact that these finely divided powders or dusts generally do not cause splattering of the flaming oil or grease. While potassium aluminum flouride and mono- and di-ammonium phosphates have certain advantages over the more common types of dry chemical fire extinguishers, these materials are substantially more expensive. Therefore, the ideal and most effective materials in this category are the alkali metal bicarbonates and the alkaline earth metal carbonates, such as, sodium and potassium bicarbonates and calcium carbonate. The alkaline earth metal carbonates and alkali metal bicarbonates release carbon dioxide when the extinguishing material is heated by the flame of the ignited material. This carbon dioxide is, of course, heavier than air and blankets the flaming material, thus preventing access to ambient air. One drawback of dry type fire extinguishing agents is their tendency to cake or agglomerate when subjected to moisture, even of the atmosphere, over long periods of time. Consequently, the free flowing character of the material is reduced so that it may be difficult to expel from the extinguisher when needed. This problem, however, has been satisfactorily solved by the addition to the dry chemical extinguishing agent of very small amounts of dissicants; for example, magnesium stearate, talc, silica, silica gel, diatomaceous earth, calcium chloride, etc. While the dry chemical fire extinguishing agents previously mentioned, particularly the carbonates and bicarbonates, are quite effective in initially extinguishing Class B type fires, it has been found that these materials alone lack the capacity to hold the extinguished condition and prevent or abate flashback or reignition. As previously mentioned, such flashback or reignition generally follows if the heat is not cut off beneath the cooking utensil or the like item containing the grease or oil.

Finally, in both liquid and dry extinguishing materials, there are those which release toxic gases or leave toxic residues.

It is therefore an object of the present invention to provide a solution to the above-mentioned problems of the prior art fire extinguishing compositions. Another and further object of the present invention is to provide an improved dry fire extinguishing composition. Yet another object of the present invention is to provide an improved dry fire extinguishing composition which is particularly useful in extinguishing Class B fires. Still another object of the present invention is to provide an improved dry fire extinguishing composition which is particularly useful in extinguishing Class B fires on cooking units. A further object of the present invention is to provide an improved dry fire extinguishing composition which is relatively inexpensive. Another object of the present invention is to provide an improved dry fire extinguishing composition which is non-toxic and has no serious after effects when utilized for extinguishing fires on cooking units. A still further object of the present invention is to provide an improved dry fire extinguishing composition which is capable of rapidly extinguishing a Class B fire. Another object of the present invention is to provide an improved dry fire extinguishing composition which is highly effective in preventing or abating flashback or reignition after the fire has been initially extinguished. Another and further object of the present invention is to provide an improved dry chemical fire extinguishing material which is highly effective in rapidly extinguishing the initial flame and is also highly effective in preventing or abating flashback or reignition even though the heat adjacent the ignited material is not reduced. Yet another object of the present invention is to provide an improved dry fire extinguishing composition which is capable of withstanding varying temperatures and conditions of high humidity over extended periods of time without deterioration. These and other objects and advantages of the present invention will be apparent from the following detailed description.

Summary of the Invention

The present invention comprises a dry chemical fire extinguishing composition comprising, a fire extinguishing agent consisting of about 50 to 95% by weight of a solid, particle-form compound, capable of generating carbon dioxide by heat decomposition, selected from the group consisting of alkali metal carbonates, alkali metal bicarbonates, alkaline earth metal carbonates and alkaline earth metal bicarbonates and about 50 to 5% by weight of a solid, particle-form metal silicate. The composition may also include minor amounts, up to about 5%, of conventional dissicants, lubricants, adsorbents and the like.

DESCRIPTION OF THE PREFERRED EMBODIMENTS

In accordance with the present invention, it has been discovered that Class B and C fires, particularly grease fires on a cooking range, can be rapidly extinguished and flashback or reignition can be prevented even though the heat under the cooking utensil is not turned off, by utilizing as an extinguishing agent a synergistic mixture of about 50 to 95% by weight of an alkali metal carbonate, an alkaline earth metal carbonate, an alkali metal bicarbonate or an alkaline earth metal bicarbonate and about 50 to 5% by weight of a metal silicate. Preferably, the amount of carbonate or bicarbonate is about 85 to 60% by weight and the amount of metal silicate is about 15 to 40% by weight. While the composition may also include minor amounts of up to about 5% by weight of conventional dissicants, lubricants, adsorbents and the like, it has also been found that the synergistic mixture has outstanding free-flowing characteristics, making its discharge from a suitable extinguishing apparatus superior to most conventional extinguishing agents, that it has resistance to stratification in storage and in an extinguishing apparatus, that it is capable of withstanding extreme temperatures without deterioration, thereby providing a long shelf life and useful life without recharging or replacement and that it is relatively resistant to moisture deterioration. The metal silicate is preferably a nontoxic alkali or alkaline earth metal silicate and of a substantially pure character, such as, a material manufactured by precipitation. A highly effective silicate for use in accordance with the present invention is "Silene L", manufactured by Pittsburgh Plate Glass Company, Pittsburgh, Pennsylvania. This material is a precipitated calcium silicate and has an approximate analysis of CaO 19 percent and $SiO_2$ 57 percent; and a loss on ignition of about 14 percent. It has a specific gravity of about 2.1 and a bulk density of about 15 to 16 pounds per cubic foot.

The composition of the present invention is particularly suited for use in the fire extinguishing system disclosed and claimed in copending application Ser. No. 131,333, entitled, "FIRE EXTINGUISHING APPARATUS," filed Apr. 5, 1971 by the present inventor. The description of this system as set forth in said copending application is incorporated herein by reference. Briefly, the system includes a flame-actuated sensor wire or pyrotechnic wire deployed at the lower lip of a cooking range hood, for example, "Pyrofuze," manufactured by Pyrofuze Corp., Mount Vernon, New York, which is a paladium-aluminum wire. Such wires will withstand radiant temperatures in excess of about 1200° F without accidental actuation. The sensor wire is connected to a mechanical triggering device which upon contact of the sensor by flame opens a small carbon dioxide cartridge or the like which pressurizes the extinguisher cylinder, thereby rupturing a pair of frangible discs on either side of the packed extinguishing agent in the extinguisher and expels the dry chemical charge through a plurality of nozzles, each of which is directed at one quadrant of the cooking surface. A free-floating piston traversing the total length of the cylinder containing the chemical extinguishing agent travels the entire length of the extinguisher cylinder as a result of the developed gas pressure, thereby achieving a complete, uniform delivery of the chemical extinguishing agent. The frangible discs also serve to protect the charge of chemical extinguishing agent from water vapor and oil mist normally encountered in a kitchen range environment. A suitable material for this purpose is a laminate of paper-polyethylene-aluminum foil-vinyl having a center section that will rupture near or below 15 pounds per square inch pressure. Preferably, the extinguisher cylinder is located within the under carriage of the range hood. The extinguishing composition of the present invention is packed under pressure into the cylinder and the cylinder is then sealed with the above-mentioned frangible disks on either end. The piston is then deployed in one end of the cylinder and behind this is a suitable gas cartridge such as a $CO_2$ cartridge, which is, in turn, attached to the sensor wire. The dispersing nozzles are, of course, mounted on the opposite end of this cylinder.

In developing the system described immediately above and the composition of the present invention, a number of tests were carried out by hand application of the extinguishing agent and by application of the extinguishing agent by nearly 400 tests in the extinguisher system referred to. The testing was carried out, in most cases, utilizing an off-the-shelf gas cooking surface.

Various vessel sizes and materials were tested including cast aluminum, sheet aluminum, cast iron, sheet steel and teflon coated cooking utensils. A 10 inch diameter stamped sheet steel skillet was found to the most problematical and was selected for most of the tests.

Various common consumer flammables were tested including corn oil, vegetable shortening, heavy duty peanut oil, animal fat (bacon grease), used restaurant grease and safflower oil, with and without foods in the oil. Heavy duty peanut oil demonstrated the greatest tendency to reignite and was used in most of the tests.

The burners of the range were all rated for BTU output. It was found that the greatest difficulty in preventing reignition was encountered when using a 102 BTU burner.

The chemical extinguishing compositions were tested for their ease and completeness of discharge from the extinguishing unit, their tendency to cause splashing or splattering of liquid oils and greases, their ability to quickly extinguish a flame, their ability to prevent reignition for at least 10 minutes and their ability to withstand prolonged extremes of heat and cold without deterioration.

The best commercially available dry chemical fire extinguishing compositions were tested as well as various combinations of the ingredients of these compositions. The following Table 1 shows the results of the testing of these commercially available materials. In the following table, some of the tests conducted for the purpose of determining the reignition properties were conducted by hand application of the extinguishing composition. In this case, the material was hand-shaken from a perforated, two-quart saucepan. In the remaining tests, the extinguishing composition was discharged from the previously described extinguishing apparatus. The material referred to below as "Super K" is a material of unknown composition developed by the U.S. Navy for this purpose. Composition number 4 is a commercially available extinguishing material whereas composition number 5 represented a mixture of 90% of this commercially available material mixed with 10% calcium silicate. In rating the completeness of discharge from the extinguisher, it was considered that discharge of less than about 85% of the chemical fire extinguishing composition from the apparatus was a failure while discharge of more than this amount was considered to pass the test. A passing rate for reignition was based on prevention of reignition for at least 10 minutes with the range burner still on.

TABLE 1

| Test Series | (% by Wt.) Chemical Composition | Type of Test | Manner of Application | Fire Extinguishment | Reignition | Discharge | Remarks |
|---|---|---|---|---|---|---|---|
| 1 | $KHCO_3$ | Chemical | Cannister | Pass | Fail | Fail | Tendency to "cake" |
| 2 | $NaHCO_3$ | System | Cannister | 4 Pass - O Fail | 2 Pass - 2 Fail | 4 Pass | 1 Gas release incomplete |
| | | Reignition | Hand | 4 Pass - 2 Fail | 2 Pass - 2 Fail | — | 2 Boil-overs contributed to reignition |
| 3 | $CaSiO_3$ | Reignition | Hand | Pass | Fail | — | — |
| 4 | 87$KHCO_3$<br>10$CdSiO_3$<br>3 Silica Gel | System | Cannister | Fail | — | Fail | Chemical block in extinguisher |
| 5 | 78.3 $KHCO_3$<br>19.0 $CaSiO_3$<br>2.7 Silica gel | System | Cannister | Fail | — | Fail | Gas channeled through chemical and nozzles plugged |
| 6 | 67.5 $KHCO_3$<br>20.0 $NaHCO_3$<br>10.0 $CaSiO_3$<br>2.5 Silica Gel | System | Cannister | 2 Fail | — | 2 Pass | Chemical too widely dispersed |
| 7 | 57 $KHCO_3$<br>30 $NaHCO_3$<br>10 $CaSiO_3$<br>3 Silica Gel | System | Cannister | 2 Fail | — | 2 Pass | — |
| 8 | 80 $NaHCO_3$<br>20 $CaCO_3$ | Chemical | Hand | Fail | — | — | — |

TABLE 1-continued

| Test Series | (% by Wt.) Chemical Composition | Type of Test | Manner of Application | Fire Extinguishment | Reignition | Discharge | Remarks |
|---|---|---|---|---|---|---|---|
| 9 | 70 $NaHCO_3$<br>30 $Na_3B(PO_4)_2$ | Reignition | Hand | 3 Pass | 1 Pass - 2 Fail | — | 2 Boil-overs contributed to reignition |
| 10 | 50 $NaHCO_3$ | System | Cannister | Pass | Fail | Pass | Some chemical compacted |
| | 50 $Na_3B(PO_4)_2$ | Reignition | Hand | Fail | — | — | — |
| 11 | 60 $NaHCO_3$ | Reignition | Hand | 2 Pass | 1 Pass - 1 Fail | 2 Pass | |
| | 40 $Na_3B(PO_4)_2$ | System | Cannister | 5 Pass | 1 Pass - 4 Fail | 4 Pass - 1 Fail | 1 Boil-over contributed to reignition |
| 12 | 72 $NaHCO_3$<br>18 $CaSiO_3$<br>10 $Na_3B(PO_4)_2$ | Reignition | Hand | Fail | — | — | — |
| 13 | 80 $NaHCO_3$<br>10 $CaSiO_3$<br>10 $Na_3B(PO_4)_2$ | Reignition | Hand | Pass | Fail | — | Boil-over contributed to reignition |
| 14 | 90 $NaHCO_3$<br>5 $CaSiO_3$<br>5 $Na_3B(PO_4)_2$ | Reignition | Hand | Pass | Fail | — | Boil-over contributed to reignition |
| 15 | "Super K" | Discharge | Cannister | — | — | 9 Pass - 8 Fail | Piston stopped in several runs |
| | | System | Cannister | 4 Fail | — | 3 Pass - 1 Fail | |

The results of the series of tests set forth in Table 1 make it obvious that the compositions tested had an inordinently large number of failures in one respect or another and therefore, are not suitable for a reliable extinguishing system of this character. Very few of these compositions were found to pass all of the basic criteria.

It was then surprisingly discovered that a mixture of sodium bicarbonate or other alkali metal or alkaline earth metal carbonates and bicarbonates in combination with a metal silicate, such as calcium silicate, produced a synergistic effect and that this combination was highly successful in extinguishing Class B fires particularly in the system previously described. The following Table 2 sets forth the results of a series of tests conducted with sodium bicarbonate alone and calcium silicate alone as well as various mixtures of these two materials.

TABLE 2

| Test Series | Chemical Composition (% by Wt.) | Type of Test | Manner of Applicaton | Fire Extinguishment | Reignition | Discharge | Remarks |
|---|---|---|---|---|---|---|---|
| 1 | $NaHCO_3$ | System | Cannister | 4 Pass - 0 Fail | 2 Pass - 2 Fail | 4 Pass | 1 Gas release incomplete |
| | | Reignition | Hand | 4 Pass - 2 Fail | 2 Pass - 2 Fail | — | 2 Boil-overs contributed to reignition |
| 2 | 95 $NaHCO_3$ | System | Cannister | Pass | Fail | Pass | considerable splatter |
| | 5 $CaSiO_3$ | Reignition | Hand | 2 Pass | 2 Pass | — | — |
| 3 | 90 $NaHCO_3$ | System | Cannister | 4 Pass | 3 Pass - 1 Fail | 4 Pass | — |
| | 10 $CaSiO_3$ | Reignition | Hand | 14 Pass | 8 Pass - 6 Fail | 14 Pass | 3 Boil-overs contributed to reignition |
| 4 | 85 $NaHCO_3$ | Reignition | Hand | 11 Pass - 1 Fail | 7 Pass - 4 Fail | — | |
| | 15 $CaSiO_3$ | System | Cannister | 9 Pass | 7 Pass - 2 Fail | 8 Pass - 1 Fail | — |
| 5 | 80 $NaHCO_3$ | Reignition | Hand | 3 Pass | 2 Pass - 1 Fail | — | — |
| | 20 $CaSiO_3$ | System | | 45 Pass - 1 Fail | 30 Pass - 11 Fail<br>4 Inconclusive | 38 Pass - 8 Fail | 4 Inconclusive reignitions due to putting burner out<br>2 Reignition failures due to poor placement of chemical<br>1 Discharge failure due to gas channeling<br>3 Discharge failures due to equipment failure |
| 6 | 75 $NaHCO_3$<br>25 $CaSiO_3$ | System | Cannister | 2 Pass - 1 Fail | 2 Fail | 2 Pass - 1 Fail | 1 Reignition failure and 1 extinguishment failure due to poor placement of chemical<br>1 Reignition failure<br>1 discharge failure due to gas discharge incomplete |
| 7 | 70 $NaHCO_3$ | System | Cannister | Pass | Fail | Pass | — |
| | 30 $CaSiO_3$ | Reignition | Hand | 2 Pass | 1 Pass - 1 Fail | — | — |
| 8 | 60 $NaHCO_3$ | System | Cannister | 3 Pass | 3 Fail | 3 Pass | — |
| | 40 $CaSiO_3$ | Reignition | Hand | 1 Pass - 2 Fail | 1 Pass | — | — |

TABLE 2-continued

| Test Series | Chemical Composition (% by Wt.) | Type of Test | Manner of Applicaton | Fire Extinguishment | Reignition | Discharge | Remarks |
|---|---|---|---|---|---|---|---|
| 9 | 50 $NaHCO_3$ 50 $NaHCO_3$ | System | Cannister | 5 Pass - 1 Fail | 1 Pass - 4 Fail | 6 Pass | 1 Extinguishment failure and 2 reignition failures due to poor placement of chemical |
| | | Reignition | Hand | Pass | Pass | Pass | |
| 10 | $CaSiO_3$ | Reignition | Hand | Pass | Fail | — | — |

It is apparent from the above that a composition containing from about 95 to 50% by weight of sodium bicarbonate and from about 5 to 50% by weight of calcium silicate was highly effective for purposes indicated. Where less 5% calcium silicate or no calcium silicate was used, it is obvious that the results are little better than those with the previously tested materials of Table 1. Likewise, a large number of failures were found to occur, particularly on the tendency to reignite, when 50% of sodium bicarbonate is mixed with 50% of calcium silicate. It is also significant that at less than about 15% calcium silicate, the results were relatively poor and at more than about 40% calcium silicate, the results were also relatively poor compared with compositions containing between about 15 and 40% of calcium silicate. Consequently, the preferred compositions in accordance with the present invention contain about 85 to 60% of sodium bicarbonate and 15 to 40% of calcium silicate. These ranges are also applicable to use of other alkali metal and alkaline earth metal carbonates and bicarbonates and other metal silicates.

While it is not intended to be limited to any specific theory of the effectiveness of the composition of the present application, it is believed that the ability of this composition to prevent reignition is due to the formation of a hard, air impermeable crust on top of the flammable liquid, thereby preventing air from reaching the flammable material and causing auto ignition of the flammable material. This is particularly significant since in many of the tests, a six-channel temperature recorder was employed having sensors in the oil, at the nozzle of the extinguisher, at the actuator of the extinguisher (gas bottle), between the heat shield of the extinguisher and the extinguisher, at the hood filter and at room temperature. As a result of checking these temperatures, it was found that the temperature in the oil after extinguishment of the initial fire and with the range burner still on was substantially higher than the initial autoignition temperature of the oil.

It was also determined to the most effective composition in accordance with the present invention was one containing 80% sodium bicarbonate and 20% of calcium silicate. The effectiveness of this composition is best illustrated by a series of tests carried out to establish compliance with the Standard of Underwriters Laboratories, Inc. for the classification, rating and fire testing of Class B-1 fire extinguishers. Some of the more significant criteria set forth in these performance specifications include, fire tests utilizing a square steel pan 8 inches in depth made from ¼ inch thick steel, 2½ feet square and partially filled with water if necessary having 2 inch layer of oil or n-heptane reaching a height of about 6 inches plus or minus ¼ inch below the top edge of the pan. The extinguisher is to be located 24, 28 and 30 inches above the oil surface. The sensors and actuation system must be capable of discharging dry chemical within a maximum of 5 seconds. The tests must also be conducted so that the chemical will be discharged over an area 40 inches by 30 inches (the largest standard range surface). If a range hood is utilized with a blower, the blower must be operated at its rated capacity and if it has a variable speed, at its highest rated speed. The duration of discharge of the chemical must be at least 8 seconds. The dry chemical must be capable of being discharged when the extinguisher is conditioned at any temperature in the range of about 70° F to 150° F. The extinguisher must also discharge at least 85% of the dry chemical charge. The following Table 3 sets forth the results of a series of tests carried out to meet the Underwriters' specifications. In this series of runs the extinguisher was "preconditioned" by storage for the specified period of time at either 32° F or 120° F. It should also be noted that in tests 4 and 7, which are the most severe, the sensor wire, the extinguisher and the inside of the hood were coated with used grease prior to the test in order to determine whether the grease would be ignited at any time during the course of the test.

TABLE 3

| Test No. | Type of Test | Conditioning Test & Time | Nozzle Height (In.) | Test Vessel | Test Fuel | Time in Sec. Actuation | Time in Sec. Extinguish | Reignition - Test Time | Delivery or Splash |
|---|---|---|---|---|---|---|---|---|---|
| 1 | Extinguish | 32° 20 hrs. | 30 | Dutch oven (11 × 7 in.) | ¼ in. Peanut Oil | 37.6 | 45.5 | Pass 17 min. | Pass |
| 2 | Extinguish | 32° 21 hrs. | 30 | Cast iron skillet (13 ¼ × 2 in.) | 0.37 in. Peanut Oil (1 lb.) | 63.0 | 70.0 | Pass 29 min. | Pass |
| 3 | Extinguish | 32° 22 hrs. | 30 | Steel Skillet (10 × 2 in.) | 0.35 in. Peanut Oil (½ lb.) | 43.0 | 45.8 | Pass 22 min. | Pass |
| 4 | Extinguish | 32° 14 hrs. | 30 | Steel pan (24 × 30× 3 in.) | 0.40 in. Peanut Oil (4.4 lb.) | 25.0 | 29.0 | Pass 75 min. | Pass |
| 5 | Extinguish | 32° 16 hrs. | 30 | Steel Skillet (10 × 2 in.) | 0.40 in. Vegetable Oil (½ | 28.6 | 33.7 | Pass 63 min. | Pass |

TABLE 3-continued

| Test No. | Type of Test | Conditioning Test & Time | Nozzle Height (In.) | Test Vessel | Test Fuel | Time in Sec. Actuation | Time in Sec. Extinguish | Reignition - Test Time | Delivery or Splash |
|---|---|---|---|---|---|---|---|---|---|
| | | | | | lb.) | | | | |
| 6 | Extin-guish | 32° 6 hrs. | 30 | Steel Skillet (10 × 2 in.) | 0.40 in. Corn Oil (½ lb.) | 41.6 | 45.9 | Pass 22 min. | Pass |
| 7 | Extin-guish | 32° 7 hrs. | 30 | Steel Skillet (10 × 2 in.) | 9 strips bacon - 0.32 in. grease | 33.3 | 36.5 | Pass 24 min. | Pass |
| 8 | Splash | 120° 8 hrs. | 20 | Cast Iron Skillet (6 × 1 in.) | 0.25 in. Peanut Oil (50 g.) | 49.8 | 51.8 | Pass 20 min. | Pass |
| 9 | Splash | 120° 19 hrs. | 20 | Steel pan (24 × 30 × 3 in.) | 0.40 in. Peanut Oil (4.4 lb.) | 26.8 | 29.2 | Pass 86 min. | Pass |
| 10 | Splash | 120° 15 hrs. | 20 | Cast Iron Skillet (6 × 1 in.) | 0.25 in. Peanut Oil (50 g.) | 46.3 | 49.6 | Pass 17 min. | Pass |
| 11 | Splash | 120° 17 hrs. | 20 | Dutch Oven (11 × 7 in.) | ¼ in. Peanut Oil | 11.0 | 17.6 | Pass 24 min. | Pass |
| 12 | Extin-guish | 32° 11 hrs. | 30 | Dutch Oven (11 × 7 in.) | ¼ in. Peanut Oil | 33.6 | 41.0 | Pass 18 min. | Pass |

As a result of the testing of the system of the present invention and the composition of the present invention, it was found that surprisingly, the system met and exceeded every test to which it was subjected for Underwriters' approval. For example, while Underwriters' specifications require 1 year shelf life after which disposal of the unit or recharging is required, the present system was given a four year shelf life.

While the present invention has been described in some detail with reference to specific examples, it is to be understood that the invention is not to be limited by such examples and specifics but is to be limited only in accordance with the apended claims.

I claim:

1. A dry chemical fire-extinguishing composition, comprising; a fire extinguishing agent consisting essentially of about 50 to 95% by weight of a solid, particle-form metal carbonate, selected from the group consisting of alkali metal carbonates, alkali metal bicarbonates, alkaline earth metal carbonates, alkaline earth metal bicarbonates and mixtures thereof and about 50 to 5% by weight of a solid, particle-form synthetic metal silicate.

2. A composition in accordance with claim 1 wherein the metal carbonate is sodium bicarbonate.

3. A composition in accordance with claim 1 wherein the composition additionally contains an effective amount, up to about 5%, of an adsorbent.

4. A composition in accordance with claim 1 wherein the metal silicate is calcium silicate.

5. A composition in accordance with claim 1 wherein the fire extinguishing agent consists of about 60 to 85% by weight of the solid, particle-form compound, capable of generating carbon dioxide by heat decomposition, and about 40 to 15% by weight of the metal silicate.

6. A composition in accordance with claim 1 wherein the fire extinguishing agent consists of about 80% by weight of sodium bicarbonate and about 20% by weight of calcium silicate.

7. A composition in accordance with claim 1 wherein the composition additionally contains an effective amount, up to about 5%, of a dissicant.

8. A composition in accordance with claim 1 wherein the composition additionally contains an effective amount, up to about 5%, of a lubricant.

* * * * *